US006865352B2

(12) United States Patent
Saito

(10) Patent No.: US 6,865,352 B2
(45) Date of Patent: Mar. 8, 2005

(54) CONSOLE APPARATUS AND CONTROL METHOD FOR DEVICE

(75) Inventor: Hitoshi Saito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/364,678

(22) Filed: Feb. 12, 2003

(65) Prior Publication Data

US 2003/0223769 A1 Dec. 4, 2003

(30) Foreign Application Priority Data

Feb. 12, 2002 (JP) ..... P2002-033767

(51) Int. Cl.[7] ..... G03G 15/00
(52) U.S. Cl. ..... 399/81
(58) Field of Search ..... 399/8, 75, 81; 347/5; 715/706, 707, 709; 345/700, 707, 709, 712

(56) References Cited

U.S. PATENT DOCUMENTS 5,018,082 A * 5/1991 Obata et al. ..... 345/707
5,243,382 A * 9/1993 Takano et al. ..... 399/8
5,446,522 A * 8/1995 Tahara et al. ..... 399/8
5,950,045 A * 9/1999 Nomura et al. ..... 399/81
6,340,977 B1 * 1/2002 Lui et al. ..... 345/709
6,477,341 B2 * 11/2002 Nomura et al. ..... 399/81

* cited by examiner

*Primary Examiner*—Sandra L. Brase
(74) *Attorney, Agent, or Firm*—Sughrue Mion, PLLC

(57) ABSTRACT

When a user carries out an operation related to a setting or maintenance operation by displaying menu representations (31 to 36) on a console panel in a copying machine, if a predetermined time (five seconds) passes without a next operation of the user (51), a hint representation (40) is displayed to display a guidance message for a next operation. Under a state that the hint representation (40) is displayed, when menu buttons (12 and 13) are pressed, a screen returns a menu representation just before the hint representation (40), so that an operation just before the hint representation can be continuously carried out. Under a state that the hint representation (40) is displayed, when a stop button (15) is pressed, the screen displays a normal representation (20) in an idle state, so that a copying operation or the like can be performed.

11 Claims, 2 Drawing Sheets

CONSOLE APPARATUS AND CONTROL METHOD FOR DEVICE

BACKGROUND OF THE INVENTION

The present invention relates to an improvement of a console apparatus of various kinds of machines such as a copying machine or a printer.

A copying machine is described as an example. A console panel of a certain kind of copying machine includes a display screen for displaying information related to the operation or the setting of the copying machine, a copying button for performing a copying operation, a stop button for stopping the copying operation, menu buttons for displaying the menus of various kinds of settings and various kinds of maintenance operations on the display screen and selecting buttons for selecting a desired setting or maintenance operation from the displayed menus.

Ordinarily, the content of a current main setting or a state capable of copying or the like is displayed on the display screen. When a user desires to set the number of copies, the size of copying sheets, or to carry out the maintenance operation such as the change of ink cartridges or cleaning of a printing head, the user operates the menu buttons. Then, the user switches the contents of the display on the display screen to a desired menu representation from a normal representation. Further, the user selects a desired setting value or starts a desired maintenance operation by operating the selecting buttons or the like.

As described above, when the user displays the menu representation on the screen to carry out the operation such as the setting or the maintenance, the user may possibly desire to complete the above-described operation and perform a copying operation instead thereof. In this case, the user may not possibly see how to operate buttons. Further, during the operation, the user may not know how to carry out the operation from now on during the operation, and accordingly, the user may possibly begin to read an operation manual. In any case, the user unaccustomed to an operating method consumes a wasteful time.

As one countermeasure of this problem, when a predetermined time passes without further operation of buttons by the user during the setting operation using the menu representation or the like, a method is employed that the display screen is automatically returned to the original normal representation from the menu representation. However, in this method, when the user reads a manual during the setting operation, the screen is disadvantageously returned to the normal representation during that time so that the user needs to perform again the setting operation from a beginning.

SUMMARY OF THE INVENTION

Accordingly, it is an object of the present invention to make various kinds of operations related to the menu representation of a console panel more understandable to a user.

In order to solve the aforesaid object, the invention is characterized by having the following arrangement.

(1) A console apparatus for controlling a device comprising:

a display device and at least one buttons, wherein display on the display device and the device is controlled in response to a button operation by a user;

a normal display unit for displaying a normal representation on the display device when the device is in a normal state in which the button operation is waited for under a condition in which the device is capable of executing an essential operation of the device upon predetermined button operation;

a menu display unit for displaying a menu representation related to one of a setting and maintenance operation when the device is in a setting state in which a button operation is waited for under a condition in which the device is capable of executing or controlling the one of the setting or maintenance operation upon predetermined button operation;

a hint display unit for displaying a hint representation showing a guidance or a hint related to a next button operation on the display device when a predetermined time passes without the button operation under the setting state;

a returning unit for returning the state of the device to the normal state upon a first button operation when the hint representation is displayed; and a redisplaying unit for redisplaying the menu representation upon a second button operation when the hint representation is displayed.

(2) The console apparatus according to (1), wherein.

the menu display unit can selectively display a plurality of menu representations including a menu representation of an execute system for a specific maintenance operation and a menu representation of a setting system except the menu representation of the execute system, and when a third button operation is performed in a state the hint representation is displayed and a menu representation displayed immediately before the hint representation is the menu representation of the execute system, an executing unit provided in the console apparatus executes the same operation or control as an operation or a control of the menu representation of the execute system immediately before the hint representation.

(3) The console apparatus according to (1), wherein the guidance or the hint related to the first and second button operations is shown in the hint representation (4) A method of displaying displays on a display device of a console apparatus for controlling a device, in which the display on the display device and the device is controlled in response to a button operation by a user, the method comprising the steps of:

displaying a normal representation on the display device when the device is in a normal state in which the button operation is waited for under a condition in which the device is capable of executing an essential operation of the device upon predetermined button operation;

displaying a menu representation related to a setting or maintenance operation on the display device when the device is in a setting state in which a button operation is waited for under a condition capable of executing or controlling the setting or maintenance operation upon predetermined button operation;

displaying a hint representation showing a guidance or a hint related to a next button operation on the display device when a predetermined time passes without the button operation under the setting state;

returning the state of the device to the normal state upon a first button operation when the hint representation is displayed; and redisplaying the menu representation upon a second button operation when the hint representation is displayed.

The present disclosure relates to the subject matter contained in Japanese patent application No. 2002-033767 (filed on Feb. 12, 2002), which is expressly incorporated herein by reference in their entireties.

DETAILED DESCRIPTION OF PREFERRED EMBODIMENTS

Figure 1:
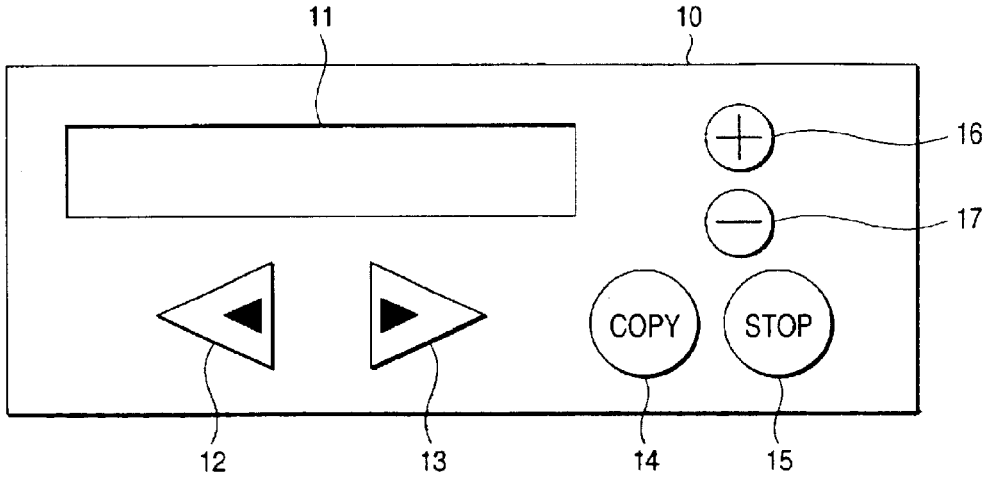
FIG. 1 is a plan view showing the structure of a user interface (console panel) of a console apparatus for an ink jet-type copying machine according to one embodiment of the present invention.

FIG. 1 shows a structure of a user interface (console panel) of a console apparatus for an ink jet-type copying machine according to one embodiment of the present invention.

As shown in FIG. 1, a liquid crystal display device (LCD) 11, right and left menu buttons 12 and 13, a copying button 14, a stop button 15, upper and lower selecting (scroll) buttons 16 and 17 are provided on a console panel 10. The LCD 11 displays information related to the operation or the state of a setting of the copying machine or the like. The copying button 14 is basically operated for performing a copying operation. The stop button 15 is basically operated for stopping the copying operation. The menu buttons 12 and 13 are basically operated to display on the LCD 11 menus for various kinds of settings such as the number of copying sheets or the size of copying sheets and various kinds of maintenance operations for changing ink cartridges or cleaning a head, etc. The selecting buttons 16 and 17 are basically operated to select desired setting values or maintenance operations from displayed menus.

The various kinds of buttons 12 to 17 can be used for other purposes than the above-mentioned basic purposes. In this embodiment, especially, the menu buttons 12 and 13 and the stop button 15 are used for special purposes according to the principle of the present invention as described below.

Figure 2:
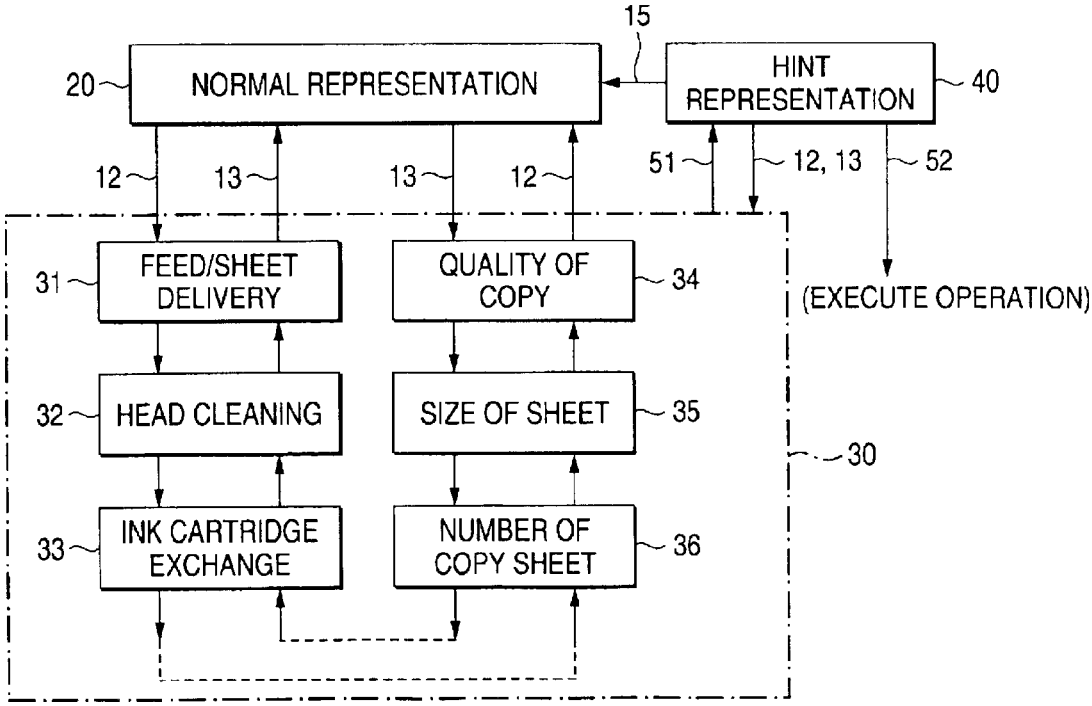
FIG. 2 is a diagram showing a state of transition of a display of an LCD 11 in accordance with a button operation on the console panel 11.
Figure 3:
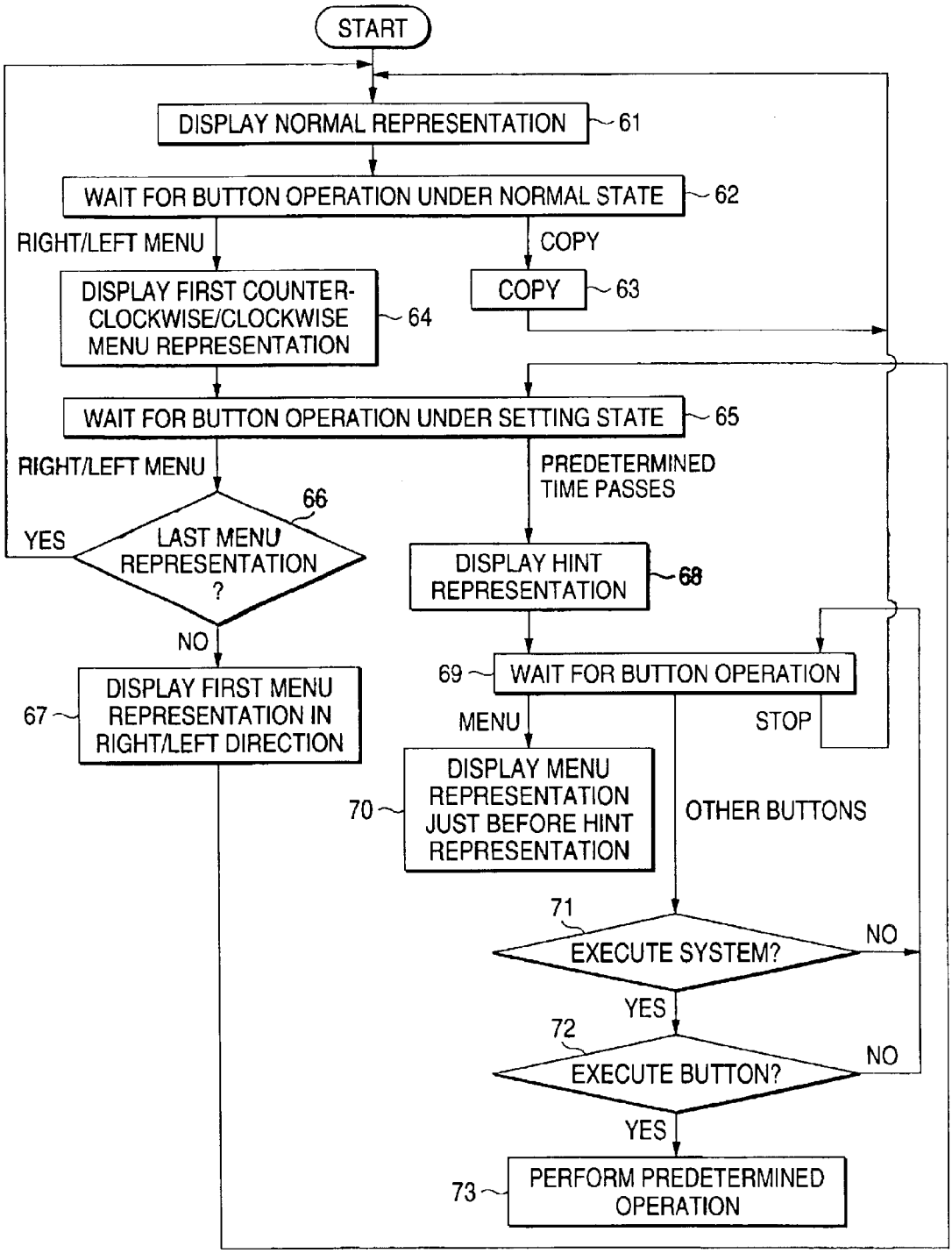
FIG. 3 is a flow chart showing a flow of a control operation of the console apparatus in accordance with the button operation on the console panel 11.

FIG. 2 shows a state of transition of a display of the LCD 11 in accordance with a button operation on the console panel 10. FIG. 3 shows a flow of a control operation of the console apparatus in accordance with a button operation on the console panel 10.

As shown in FIGS. 2 and 3, when the copying machine is activated and completely initialized, the copying machine is firstly brought into an "normal state". In the normal state, the copying machine waits for the button operation from a user under a condition that the copying machine can perform a copying operation when the copying button 14 is pressed (steps 61 and 62). Under this normal state, the copying machine displays a normal representation 20 on the LCD 11 (step 61). On the normal representation 20, for instance, current main setting values related to the copying operation (the number of copy sheets, the magnification of copy, the size of copy sheets, etc.), or a message showing that the copying operation can be carried out are displayed. When the copying button 14 is pressed under the normal state, the copying machine carries out the copying operation on the basis of the current setting values (step 63).

When the left menu button 12 or the right menu button 13 is pressed under the normal state, the copying machine enters a "setting state". In the setting state, the copying machine waits for the button operation of the user under a condition that the copying machine can perform or control a setting or a maintenance operation desired by the user upon predetermined button operation (steps 64 and 65). That is, when the left menu button 12 is pressed under the normal state, the copying machine firstly displays on the LCD 11 a first counterclockwise menu representation. That is, a sheet feed/sheet delivery menu representation 31, of a plurality of menu representations 30 (31 to 36) linked in a ring form as shown in FIG. 2 is displayed (step 64). Then, the copying machine enters the setting state in which the sheet feed or sheet delivery operation can be executed upon predetermined button operation and waits for a next button operation of the user (step 65). On the other hand, when the right menu button 13 is pressed, the copying machine firstly displays on the LCD 11 a first clockwise menu representation, that is, a copy quality menu representation 34 (step 64). Then, the copying machine enters the setting state in which the setting of a copy quality can be performed upon predetermined button operation and waits for a next button operation of the user (step 65).

After the first menu representation 31 or 34 is displayed, every time the left menu button 12 or the right menu button 13 is pressed, the copying machine shifts the representation of the LCD 11 to a next counterclockwise or clockwise menu representation (step 67) shown in FIG. 2. Then, the copying machine enters a setting state corresponding to a new menu representation, and then, waits for a next button operation of the user (step 65). When the left menu button 12 or the right menu button 13 is pressed, if the contents of the menu representation immediately before the new menu representation show the last counterclockwise or clockwise menu representation shown in FIG. 2, in other words, the copy quality menu representation 34 or the sheet feed/sheet delivery menu representation 31 (yes in step 66), the menu representation on the LCD 11 is returned to the normal representation 20. The state of the copying machine is returned to the normal state from the setting state.

In such a way, the menu buttons 12 and 13 are operated so that the state of the copying machine is switched to the setting state from the normal state. Thus, the copying machine sequentially displays the plural menu representations 31 to 36 shown in FIG. 2 on the LCD 11, and then, the copying machine can return again to the normal state. In this connection, the menu representations 31 to 36 shown in FIG. 2 are exemplified only for explanation. Accordingly, more kinds of menu representations or different kinds of menu representations may be provided.

The plural menu representations 31 to 36 shown in FIG. 2 are roughly divided into the menu representations for performing various kinds of maintenance operations such as the sheet feed sheet delivery menu representation 31, a head cleaning menu representation 32 and an ink cartridge menu representation 33, and the menu representations for various types of settings such as the copy quality menu representation 34, a sheet size menu representation 35 and a copy number menu representation 36. In a loop type link of these menu representations 31 to 36, the menu representations 31 to 33 for the maintenance operations are continuously arranged counterclockwise from the normal representation 20 as a starting point, and after them, the menu representations 34 to 36 for setting are continuously arranged. It is to be understood that the menu representations 31 to 36 are arranged in order reverse to the above order. Accordingly, when the user desires to perform a certain maintenance operation, if the user presses the left menu button 12, the user can rapidly reach the desired menu representation. On the other hand, when the user desires to change a certain setting, if the user presses the right menu button 13, the user can rapidly reach the desired menu representation.

Although illustrations are omitted in FIGS. 2 and 3, while any of the menu representations 34, 35 and 36 for setting is displayed, when the upper or lower selecting button 16 or 17 is pressed, a sub-menu representation is displayed on the LCD 11 for selecting a desired setting value front a plurality of predetermined setting values (selection branches) related to the setting items of the menu representation (for instance, the quality of copy, the size of copy sheets or the number of copy sheets, etc.). Then, one desired setting value can be selected and set in the copying machine. At that time, when a certain setting value is selected by the selecting button 16 or 17, the selected setting value is automatically set in the copying machine. Therefore, an operation for setting the selected setting value is not needed separately from the operation for selecting the setting value.

Further, although an illustration is also omitted, while any of the menu representations 31, 32 and 33 for the maintenance operations is displayed, the predetermined button (the copying button 14 or the upper or lower selecting button 16 or 17 determined for each maintenance operation) is pressed. At this time, the maintenance operation of a currently displayed menu representation (for instance, the sheet feed/sheet delivery, the change of ink cartridges, the head cleaning, the display of remaining amount of ink, etc.) can be performed or controlled. In this case, depending on the kinds of maintenance operations, a sub-menu representation (for instance, a sub-menu representation for sequentially performing a changing procedure including a plurality of steps when the ink cartridge is replaced by a new cartridge, etc.) may be sometimes displayed.

While any of the above-described menu representations 31 to 36 (or the above-described sub-menu representations) is displayed, the copying machine waits for a next button operation of the user (step 65). At that time, when a predetermined time, for instance, 30 seconds, passes without the next button operation of the user, the copying machine displays a predetermined hint representation 40 on the LCD (step 68 and an arrow mark 51 shown in FIG. 2) and waits for a next button operation of the user (step 69). In this hint representation 40, a hint or guidance message for a next button operation, for instance, "If you press the stop button, you can return to the first screen at any time. Here, if you press the menu button, you can return to the menu." is displayed. This hint representation 40 is continuously displayed until the user performs the next button operation.

While the hint representation 40 is displayed, when the left or the right button 12 or 13 is pressed, the copying machine displays a menu representation immediately before the hint representation 40 is displayed on the LCD 11 (step 70) and waits for a next button operation (step 65). Consequently, in this case, the user can continue the operation using the menu representation that is halfway done.

While the hint representation 40 is displayed, when the stop button 5 is pressed, the copying machine returns to the normal state to display the normal representation 20 on the LCD 11 (step 61) and waits for a next button operation of the user (step 62). Accordingly, in this case, the user can finish the operation using the menu representation immediately before the hint representation to perform a copying operation or the like. The contents of setting when the copying machine returns to the normal state in this manner show the contents already set immediately before the hint representation 40 is displayed, as apparent from the above-description.

Although an illustration is not provided, when the menu representations 34 to 36 for setting are displayed (step 65), if the copying button 14 is pressed under this state, the copying operation having the latest setting contents at that time can be performed. Therefore, when the user presses the copying button 14 even during the setting operation, the user can finish the setting operation to carry out the copying operation. However, even a user who does not know such a shortcut can easily finish the setting operation to carry out the printing operation in accordance with guidance by the above-described hint representation.

While the above-described hint representation 40 is displayed, when the buttons except the menu buttons 12 and 13 and the stop button 15 are pressed, the copying machine decides whether or not the menu representation displayed immediately before the hint representation 40 is a menu representation of an "execute system" (step 71). Here, the menu representation of the "execute system" particularly indicates a special menu representation among the menu representations for the maintenance operations. The menu representation of the "execute syste" means a menu representation (or a sub-menu representation). for the maintenance operation. Under the menu representation of the "execute system", unless the user performs a predetermined button operation in predetermined order from a state that the menu representation is displayed to allow the copying machine to perform an operation composed of one or a plurality of steps, a purpose cannot be achieved. The menu representations for the maintenance or setting operations except the menu representations of the "execute system" are referred to as menu representations of a "setting system" in this specification. In this embodiment, the menu representation 33 for changing the ink cartridge and the menu representation 31 for sheet feed/sheet delivery are the menu representations of the "execute system" and other menu representations 32, and 34 to 36 are the menu representations of the "setting system".

As a result of decision in the step 71, when the menu representation immediately before the hint representation is the menu representation of the "setting system" (No), the copying machine neglects the button operation to continue to display the hint representation 40. On the other hand, when the representation immediately before the hint representation is the menu representation of the "execute system" (Yes in the step 71), if the pressed button is a button for performing or controlling a predetermined operation related to the menu representation of the "execute system" immediately before the hint representation (yes in step 72), the copying machine performs or controls the operation (step 73) For instance, the menu representation of the "execute system" immediately before the hint representation is the ink cartridge change menu representation 33 and the ink cartridge changing operation is determined to be carried out upon pressing the copying button 14. In this case, the ink cartridge changing operation is carried out upon pressing the copying button 14, even under a state that the hint representation 40 is displayed. While the user performs the operation related to a desired maintenance operation by using the menu representation of the execute system, when the user reads an operation manual to recognize an operating method from now on, the representation of a screen may be changed to the hint representation 40 during that time. Even in this case, when the user carries out such a button operation as described in the operation manual, such a maintenance operation as described in the operation manual can be performed or controlled according to this function.

The above-described embodiment of the present invention is exemplified for explaining the invention and the scope of the invention is not limited only to the above embodiment. Therefore, the present invention may be realized in various kinds of ways without departing the gist thereof.

What is claimed is:

1. An apparatus comprising:

an operating unit that is operated by a user; and a display unit that displays a first representation;

wherein the display unit displays predetermined information including first information for redisplaying the first representation displayed immediately before displaying the predetermined information and second information for displaying a second representation if a predetermined time passes without designating next operation by the operating unit while displaying the first representation, and an operation according to the first information causes the display unit to redisplay the first representation.

2. The apparatus according to claim 1, wherein the display unit selectively displays, as the first representation, a plurality of menu representations including an executing menu, wherein the executing menu is for executing a specific operation, and in a state that the predetermined information is displayed and the first representation is the executing menu, the specific operation is executed if the operating unit is operated for executing the specific operation according to the executing menu.

3. The apparatus according to claim 2, wherein the operation of the operating unit for executing the specific operation causes the specific operation to be executed without performing a confirmation operation of the executing menu.

4. The apparatus according to claim 1, wherein a main menu for selecting setting items is displayed as the first representation.

5. The apparatus according to claim 4, wherein when one of the setting items of the main menu is selected, a sub-menu for selecting setting values is displayed as the first representation.

6. The apparatus according to claim 1, wherein the second representation is a normal representation.

7. The apparatus according to claim 6, wherein the normal representation is a first screen.

8. The apparatus according to claim 1, wherein information related to an operation of the operating unit is displayed as the predetermined representation.

9. The apparatus according to claim 1, wherein the operating unit includes a member for the operation according to the first information and a member for an operation according to the second information.

10. A method comprising:

displaying a first representation;

displaying predetermined information including first information for redisplaying the first representation displayed immediately before displaying the predetermined information and second information for displaying a second representation if a predetermined time passes without designating next operation by an operating unit while displaying the first representation; and displaying the first representation if an operation according to the first information is performed.

11. The method according to claim 10, wherein a plurality of menu representations including an executing menu are displayed as the first representation, in which the executing menu is for executing a specific operation, the method further comprising:

in a state that the predetermined information is displayed and the first representation which is displayed immediately before displaying the predetermined information is the executing menu, executing the specific operation if the operating unit is operated for executing the specific operation according to the executing menu.

* * * * *